United States Patent [19]

Peterson

[11] 4,448,470

[45] May 15, 1984

[54] COUPLING MEMBER AND AN ELECTRICAL CONNECTOR

[75] Inventor: Ann E. Peterson, Sidney, N.Y.

[73] Assignee: The Bendix Corporation, Southfield, Mich.

[21] Appl. No.: 334,868

[22] Filed: Dec. 28, 1981

[51] Int. Cl.[3] ..... H01R 13/62

[52] U.S. Cl. ..... 339/91 R; 285/319; 285/DIG. 22

[58] Field of Search ..... 339/89 R, 89 M, 90 R, 339/91 R; 285/319, DIG. 22

[56] References Cited

U.S. PATENT DOCUMENTS

| | | | |
|---|---|---|---|
| 922,805 | 5/1909 | Nelson et al. | 285/319 |
| 3,330,341 | 7/1967 | Jackson, Jr. et al. | 285/319 |
| 3,339,944 | 9/1967 | Poague | 285/319 |
| 3,430,184 | 2/1969 | Acord | 339/91 R |
| 3,899,198 | 8/1975 | Maroschak | 285/DIG. 22 |
| 4,067,534 | 1/1978 | Frey | 285/DIG. 22 |
| 4,150,866 | 4/1979 | Snyder, Jr. et al. | 339/91 R |
| 4,214,586 | 7/1980 | Mencle | 285/DIG. 22 |
| 4,373,753 | 2/1983 | Ayers et al. | 285/319 |

FOREIGN PATENT DOCUMENTS

| | | | |
|---|---|---|---|
| 1413673 | 11/1975 | United Kingdom | 339/91 R |

*Primary Examiner*—John McQuade
*Assistant Examiner*—Gary F. Paumen
*Attorney, Agent, or Firm*—Charles D. Lacina

[57] ABSTRACT

A coupling member (30) includes four equiangularly spaced fingers (42) at one end and two deflectable tabs (50) at the other end which cooperate to couple a pair of connectors (10, 20) of the type having medial of their ends a flange (18, 28) one flange (18) being provided with four openings (48) for receiving the fingers therethrough and the other flange being of a smaller diameter than the sleeve inside diameter for receiving the tabs thereover, the coupling member telescoping over the connectors and causing the tabs to deflect over their flange (28) and the fingers to be radially deflected and abut their flange (18).

6 Claims, 6 Drawing Figures

FIG. 3
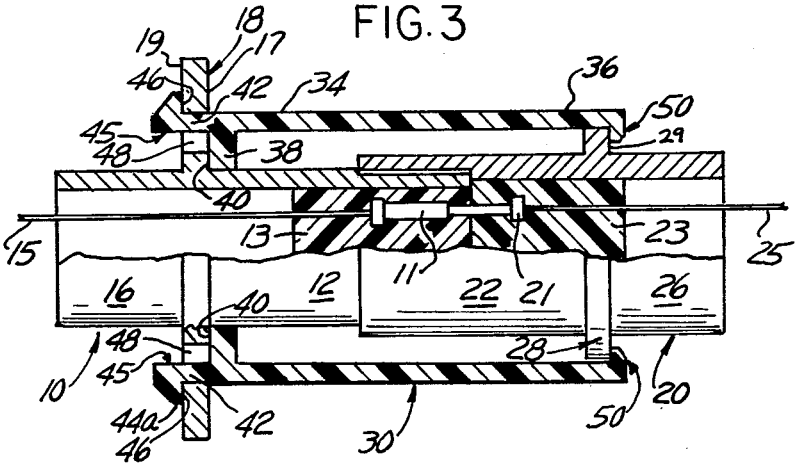
FIG. 5
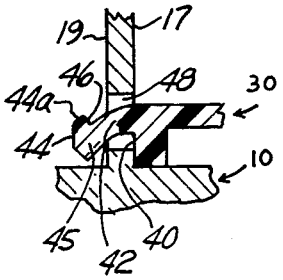
FIG. 4
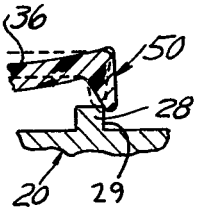
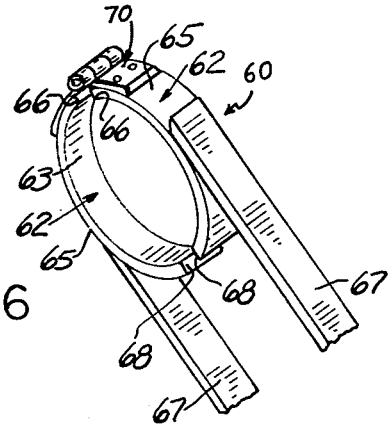
FIG. 6

COUPLING MEMBER AND AN ELECTRICAL CONNECTOR

This invention relates to a coupling member for an electrical connector.

Electrical connector assemblies are generally comprised of two separate housings, one housing having a plurality of contacts which are matable with a like plurality of contacts in the other housing when the housings are connected together. Typically, a rotatably mounted coupling ring would connect the two housings together. Previously, it has been known to provide an inner wall of the coupling ring and an outer wall of the receiving housing with threads and to captivate a flange of the coupling ring adjacent to a flange on one of the housings by one or more snap rings, rotation of the coupling ring thus drawing the two members together. In some applications, wherein an interconnection once form is not further disturbed, the formation of threads is an expensive feature not desired by a user. Further, thread formation is time consuming, prone to seizing and galling, often times must be lubricated and subject to wear. Also, in severe environmental conditions, a user sometimes desires to interconnect an assembly with speed and with great ease.

DISCLOSURE OF THE INVENTION

The invention is a one-piece coupling member for a connector assembly. The coupling member includes means for securing first and second electrical connector housings together and is characterized as tubular sleeve having opposite end faces, one end face having one or more fingers extending forwardly therefrom and the other end face having a plurality of resilient tabs extending radially inwardly therefrom, the fingers and tabs being integrally formed with the coupling member. Each of the fingers includes a hooked portion which defines an abutment shoulder that is received within an aperture of a flange on the first connector housing, the coupling member being mounted and dismounted to the first connector housing by deflecting the fingers radially inwardly and outwardly. Each of the tabs define retention means which are adapted to snap over a similar radial flange on the second electrical connector housing to which the coupling member is to be mounted.

In an another aspect, a tool having a pair of semi-circular plate portions is provided to remove the coupling member from the one housing. Each plate of the tool is hinged at one end face, thereby allowing the semi-circular faces of the plates to simultaneously press the fingers radially inwardly to deflect the hooked portion from engagement with the aperture and allow the coupling member to be removed from the one housing.

One advantage of the invention is a coupling member that reduces the number of parts and complexity of the interconnection necessary to mount a coupling member to an electrical connector housing.

Another advantage of the invention is a reduction in the assembly time necessary to mount a coupling member to a connector housing and a pair of connector housings together to form an electrical connector assembly.

Another advantage is simplicity by which a coupling member may be mounted to a connector housing and, alternately, be removed from the connector housing.

DETAILED DESCRIPTION OF THE INVENTION

FIG. 3 shows, partially in section, the coupling member coupling a pair of electircal connector housings.

FIG. 4 shows detail of a tab uncoupling.

FIG. 5 shows detail of a finger uncoupling.

FIG. 6 shows a tool for uncoupling the coupling member of FIG. 3.

Figure 1:
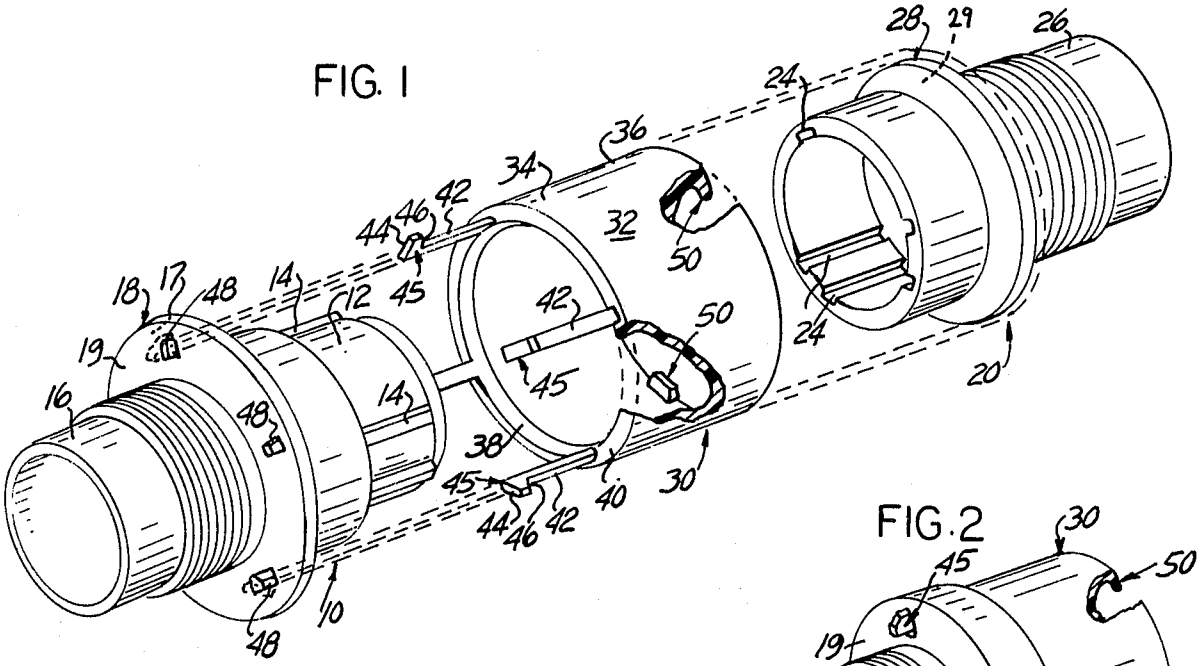
FIG. 1 is an exploded perspective view of an electrical connector having a coupling member.

Referring now to the drawings, FIG. 1 illustrates a coupling member 30 according to the principles of this invention. The coupling member 30 is adapted to secure a first connector housing 10 to a second connector housing 20.

The first connector housing (i.e. a plug shell) 10 includes an engaging forward end portion 12 having a plurality of longitudinal keys 14, a non-engaging rearward end portion 16 and a radial flange 18 disposed medially of the plug end portions. Flange 18 includes a forward face 17 facing end portion 12 and a rearward face 19 facing end portion 16.

The second electrical connector housing (i.e. a receptacle shell) 20 includes an engaging forward end portion 22 having a plurality of longitudinal internal keyways 24, the keyways being adapted to receive the plug shell keys when the forward engaging end portions of the two connector members are mated, a non-engaging rearward end portion 26 and a radial flange 28 disposed medially of the receptacle end portions having an end face 29 facing end portion 26. Although shown best in FIG. 3, each connector housing 10, 20 would mount a plurality of mateable contacts 11, 21, for mating to complete an electrical connection between respective electrical wires 15, 25.

Preferably and in accord with this invention, coupling member 30 is formed of a thermoplastic and comprises a generally cylindrically shaped tubular sleeve 32 having a forward portion 34 and a rearward portion 36, these sleeve portions being adapted to telescopically fit about the engaging forward end portion 12, 22 of the first and second connector housings 10, 20 respectively. The outer diameter of radial flange 28 would preferably be of smaller diameter than the inner diameter of sleeve 32.

The forward portion 34 of coupling member 30 includes a radial inward support ring 38 having an exterior end face 40 and a plurality of resilient fingers 42 extending axially forward from end face 40 as cantilever-type beams, each finger having a distal end thereof being provided with a tapering surface 44 and a radial abutment shoulder 46 to thereby define a hooked portion 45. As shown, four fingers of generally rectangular cross-section are disposed substantially equiangularly around end face 40 of the coupling member. Radially disposed around and extending between the faces 17, 19 of radial flange 18 of the plug shell 10 are a plurality of generally rectangular openings 48, the openings being adapted to register with and receive the fingers 42 when inserted therethrough, each tapered surface 44 deflecting the hook portion 45 remotely of the finger downwardly to allow entry and each shoulder 46 being adapted to butt against the rear flange face 19 when the hook portion has passed through the opening to prevent unwanted withdrawal. The long dimension of the rectangular opening is generally radially disposed and provides a clearance fit for the finger.

At the rearward portion 36 of coupling member 30 and radially inwardly directed from the sleeve are, as shown in the embodiment, a pair of resiliently deflectable snap tabs 50. These snap tabs are adapted to be deflected (i.e. snapped) over radial flange 28 on the receptacle connector housing 20 and engage end face 29.

Although either of the electrical connector housings 10, 20 may be of metal, it is contemplated that for ease of fabrication and manufacturing costs, both of the electrical housings could be of a durable plastic material.

Figure 2:
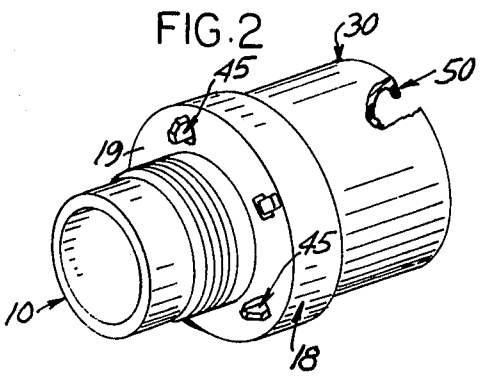
FIG. 2 shows the coupling member of FIG. 1 assembled to an electrical connector housing member.

FIG. 2 shows coupling member 30 mounted onto plug shell 10 with the distal hooked portions 45 of each finger protruding from openings in the plug flange 18 and the shoulders butting against flange rear face 19 and thereby secure coupling member 30 to the plug shell.

FIG. 3 shows, partially in section, coupling member 30 mounted to plug shell 10 and coupled to receptacle shell 20. Also shown are pin-socket-type contacts 11, 21 mounted within dielectric inserts 13, 23 to interconnect their respective wires 15, 25. The inward support ring 38 is generally telescopically clearance fitted about the engaging forward end 12 of plug shell 10. The fingers 42 and hooked portions 45 extend through openings 48 such that radial shoulders 46 butt against rear flange face 19 and end face 40 is adjacent forward flange face 17 of radial flange 18. Also, resilient tabs 50 are shown received over radial flange 28 on receptacle shell 20 to engage flange end face 29 and thereby secure the receptacle end portion 22 in mated relationship with the plug end portion 12.

FIG. 4 shows detail of a tab being uncoupled from the receptacle. A user would radially compress rearward portion 36 of the sleeve 32, such as by squeezing inwardly on the coupling member, at locations generally 90° offset from the tabs, such compression causing the tab to deflect from engagement with the flange, whereby an axial force will allow the receptacle to be uncoupled from the coupling member.

FIG. 5 shows a resilient finger 42 being deflected radially inwardly such that the hooked portion 45 thereon disengages radial shoulder 46 from abutting relationship with the rearward face 19 of flange 18 to allow coupling member 30 to be removed from the plug shell. Preferably and to aid in finger deflection tapered surface 44 may be provided with a flat **44*a*** for engagement by a release tool.

FIG. 6 shows a tool 60 for accomplishing the uncoupling of the coupling member fingers 42 from their securement to plug shell 10. Preferably and in accord with this invention, tool 60 comprises a pair of generally semi-circular plates 62, each plate having a semi-circular inner face 63, an outer face 65, and a pair of end faces 66, 68, the plates 62 being connected by a hinge 70 along their respective end faces 66. A clamping arm 67 is attached to the outer face 65 of each plate 62, the clamping arms serving to open or close the semi-circular plates 62 from open to closed positions, the closed position forcing semi-circular plates 62 and the respective end faces 68 towards one another, the plates 62 encircling hook portions 45 of the fingers 42, thus causing the hook-portions to radially compress.

OPERATION

A user would be provided with the plug and receptacle electrical connector housings 10, 20 and the coupling member 30 and the uncoupling tool 60. First the coupling member would be telescoped over and about the plug shell and the fingers 42 thrust through the flange openings 48, the openings forcing the fingers to radially deflect inwardly as the tapered surfaces 44 of the fingers enter the openings. After the hooked portions have been forced through the openings, the fingers snap radially outwardly to allow the radial shoulders 44 of the hook portions to engage the rearward face 19 of the flange 18. The receptacle member 20 would then be positioned so that the key 14 and keyways 24 line up and forced inwardly into the plug shell, full mated relationship occurring when tabs 50 have snapped over radial flange 28 of the receptacle housing.

To remove the assembly above mentioned, the receptacle connector would be forced outwardly of the coupling member by compressing about the sleeve 32 to deflect tabs 50 from enagement with flange 28. Next, the semi-circular plates 62 would be clamped radially downwardly about the flat on hook portions 45, forcing the hook portions radially downwardly and the shoulders from engagement with the radial flange, whereby the coupling member could be axially pulled from the plug connector and the connection removed.

While a preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein will be used to illustrate the principles of the invention and not to limit the scope thereof.

I claim:

1. An assembly comprising a coupling member (30) and a pair of housings (10, 20), each said housing having a forward end portion (12, 22), a rear end portion (16, 26) and at least one electrical contact (11, 21) mounted therein, the forward end portion and the contact of one said housing (10) and the forward end portion and the contact in the other said housing (20) being disposed in mated relation, the coupling member being disposed around the forward end portions (12, 22) and having a rearward portion (36) and a forward portion (34), the assembly being characterized by:

at least one resilient finger (42) extending axially from the forward portion (34) of said coupling member (30), said finger being radially deflectable inwardly and outwardly relative to the electrical connector central axis and including a transverse abutment shoulder (46);

at least one resilient tab (50) extending from the rearward portion (36) of said coupling member (30), said tab extending radially inwardly towards the central axis;

means (18, 48) on said one connector housing for retaining the abutment shoulder (46) and receiving the finger (42), said retaining means comprising said one connector housing (10) including a first radial flange (18) having an opening (48) disposed therein; and means (28) on the other connector housing (20) for receiving the tab (50), said receiving means comprising said other connector housing (20) including a second radial flange (28) having an outer diameter slightly less than the inner diameter of the coupling member (30) to allow the tab (50) to be received thereover, said finger (42) being sized to pass through said opening (48) to allow the abutment shoulder (46) to engage the first radial flange (18), said finger (42) securing the coupling member to said one connector housing and said tab (50) securing the coupling member to said other connector housing whereby said connector housings (10, 20) are coupled and secured together.

2. The assembly as recited in claim 1 wherein the coupling member (30) is an integral one-piece body comprised of thermoplastic.

3. The assembly as recited in claim 1 wherein the coupling member (30) includes four equiangularly disposed fingers (42) the first radial flange (18) includes four openings (48) disposed so as to be in register with the fingers.

4. The assembly as recited in claim 3 wherein the coupling member (30) includes two equiangularly disposed tabs (50).

5. A coupling member for an electrical connector of the type comprising first and second connector housings (10, 20) having respective forward end portions (12, 22) adapted to mate, each said connector housing having a medial radial flange (18, 28) and carrying an electrical contact (11, 21) with the contact (11) in the first connector housing (10) being adapted to mate with the contact (21) in the second connector housing (20), each said medial radial flange (18, 28) having, respectively, an end face (19, 29) thereof facing rearwardly from its forward end portion, the coupling member characterized by:

a tubular sleeve (32) including first and second end portions (34, 36), the first end portion (34) being sized to telescope about the forward end portion (12) of said first connector housing (10) and including a pair of radially outwardly disposed abutment shoulders (46), the abutment shoulders being adapted to extend behind the first radial flange (18) and seat against the end face (19) thereof when the sleeve is fitted thereto, and the second end portion (36) being sized to telescope about the forward end portion (22) of said second connector housing (20) and including a pair of radially inwardly directed tabs (50), the tabs being adapted to extend axially rearward of and seat behind the second radial flange (28) when the sleeve is fitted thereto.

6. The coupling member as recited in claim 5 wherein the first end portion (34) of the tubular sleeve (32) includes an annular end face (40) and a pair of fingers (42) extending therefrom, the fingers having a hooked portion (45) thereof spaced axially from the end face, said hooked portion including said abutment shoulders.

* * * * *